US008019273B2

(12) United States Patent
Choi et al.

(10) Patent No.: US 8,019,273 B2
(45) **Date of Patent: *Sep. 13, 2011**

(54) MOBILE COMMUNICATION TERMINAL, CHANNEL INFORMATION PROVIDING MODULE, METHOD OF AUTOMATICALLY ACCESSING TO DMB, AND METHOD OF PROVIDING CHANNEL ACCESS INFORMATION

(75) Inventors: Chang-jin Choi, Seoul (KR); Joon-young Jang, Seoul (KR)

(73) Assignee: Pantech Co., Ltd., Seoul (KR)

( * ) Notice: Subject to any disclaimer, the term of this patent is extended or adjusted under 35 U.S.C. 154(b) by 63 days.

This patent is subject to a terminal disclaimer.

(21) Appl. No.: 12/510,658

(22) Filed: Jul. 28, 2009

(65) Prior Publication Data

US 2009/0293094 A1 Nov. 26, 2009

Related U.S. Application Data

(63) Continuation of application No. 11/439,407, filed on May 22, 2006, now Pat. No. 7,583,929.

(30) Foreign Application Priority Data

Jul. 11, 2005 (KR) ..... 10-2005-0062396

(51) Int. Cl.
*H04H 1/00* (2006.01)

(52) U.S. Cl. ..... 455/3.01; 455/3.06; 455/434; 455/515

(58) Field of Classification Search ..... 455/3.01, 455/3.03, 517, 414.3, 3.04, 3.06, 418, 414.1, 455/466, 509, 452.1, 434, 515
See application file for complete search history.

(56) References Cited

U.S. PATENT DOCUMENTS

2003/0181160 A1 9/2003 Hirsch
2005/0083932 A1* 4/2005 Lee et al. ..... 370/390
2005/0160343 A1* 7/2005 Ji ..... 714/758

FOREIGN PATENT DOCUMENTS

KR 10-2005-0044844 5/2005

OTHER PUBLICATIONS

Office Action dated Dec. 31, 2008 (for co-pending U.S. Appl. No. 11/439,407).
Notice of Allowance dated May 5, 2009 (for co-pending U.S. Appl. No. 11/439,407).

* cited by examiner

*Primary Examiner* — John J Lee
(74) *Attorney, Agent, or Firm* — H.C. Park & Associates, PLC

(57) ABSTRACT

A mobile communication terminal to automatically access to DMB includes a broadcast receiving unit that receives and demodulates a DMB signal, extracts and processes a video signal and an audio signal from the DMB signal, and outputs the video signal and the audio signal to a display unit and an audio output unit; a channel information acquisition unit that processes an audio signal inputted from a microphone in an automatic channel access mode, generates and transmits to a channel information providing server a channel access information request message that includes the audio signal and time information concerning the time when the audio signal is input, and receives and outputs a channel access information response message; and a broadcast control unit that outputs a channel tuning control signal to the broadcast receiving unit according to the channel access information inputted from the channel information acquisition unit.

4 Claims, 7 Drawing Sheets

MOBILE COMMUNICATION TERMINAL, CHANNEL INFORMATION PROVIDING MODULE, METHOD OF AUTOMATICALLY ACCESSING TO DMB, AND METHOD OF PROVIDING CHANNEL ACCESS INFORMATION

CROSS-REFERENCE TO RELATED APPLICATIONS

This application is a continuation application of U.S. patent application Ser. No. 11/439,407, filed on May 22, 2006, and claims the priority from and benefit of Korean Patent Application No. 2005-62396, filed on Jul. 11, 2005, in the Korean Intellectual Property Office, the disclosure of which are incorporated herein in their entirety by reference.

BACKGROUND OF THE INVENTION

1. Field of the Invention

The present invention relates to a mobile communication terminal capable of receiving digital multimedia broadcasting (DMB) signals and, more particularly, to a technology of allowing the mobile communication terminal to automatically access to DMB.

2. Description of Related Art

With the development of mobile communication technologies, mobile carriers provide DMB services to allow users to view DMB through their mobile communication terminals. Further, the mobile carriers plan to launch terrestrial broadcasting services.

FIG. 1 is a conventional DMB service system. The DMB service system includes a broadcasting station 10, which provides various broadcast programs such as motion pictures, music video, drama and the like, a digital broadcasting satellite 20, which receives broadcast signals (14 GHz) transmitted from the broadcasting station 10 and transmits a broadcast signal of 2.6 GHz or 14 GHz bandwidth to the ground, a gap filler 30, which receives a broadcast signal of 14 GHz bandwidth and outputs a broadcast signal of 2.6 GHz bandwidth to compensate for dead spots such as downtowns, and a mobile communication terminal 40, which receives a broadcast signal of 2.6 GHz bandwidth from the digital broadcasting satellite 20 or the gap filler 30. Currently, the mobile carriers manufacture mobile communication terminals, which are so called DMB phones, capable of receiving, processing, and outputting digital multimedia broadcast signals.

On the other hand, the mobile carriers use an electronic program guide (EPG) to allow users to select and view their desired broadcast programs. The EPG includes program titles, brief remarks, and the like on a channel/time basis. In addition, a multimedia server, which transmits/receives data signals to/from mobile communication terminals over broadcasting stations or wireless data communication networks, transmits the EPG, which is periodically updated, to the mobile communication terminals.

As the mobile communication terminals are popular, it is expected that DMB services provided through the mobile communication terminals will be widely used and various kinds of programs will be provided to the mobile communication terminals. However, there is a problem in that it is very annoying for users to retrieve the EPG on a channel/time basis in order to search for their desired broadcast programs.

In order to solve this problem, a method is disclosed in Korean Patent Publication No. 10-2005-0044844 (May 13, 2005) entitled "Method and apparatus for displaying digital broadcast channel information", in which a mobile communication terminal generates broadcast channel information from an EPG, which is stored in a memory, in a broadcast viewing mode, displays the generated channel information, and allows users to select their desired programs. Accordingly, the users do not need to retrieve the EPG manually.

However, if various kinds of broadcast programs are broadcasted in the future, it will be increasingly difficult for a user to retrieve the broadcast programs only with channel information. Accordingly, when a user desires to view a broadcast program, which is currently broadcasted through TV, through the mobile communication terminal capable of implementing the above-mentioned method, the user should select channel information displayed in a display unit and check whether or not a received broadcast program is his/her desired program.

SUMMARY OF THE INVENTION

The present invention provides a technology for allowing a mobile communication terminal to automatically access to DMB (Digital Multimedia Broadcasting) when an audio signal of the DMB is input to the mobile communication terminal.

The present invention further provides a method and apparatus for providing channel access information in response to a channel access information request which is input from a mobile communication terminal.

According to an aspect of the present invention, there is provided a mobile communication terminal that can automatically access to DMB, including: a broadcast receiving unit that receives and demodulates a DMB signal, extracts and processes a video signal and an audio signal from the DMB signal, and outputs the video signal and the audio signal to a display unit and an audio output unit, respectively; a channel information acquisition unit that processes an audio signal inputted from a microphone of the mobile communication terminal in an automatic channel access mode, generates and transmits to a channel information providing server a channel access information request message that includes the audio signal and time information concerning the time when the audio signal is input, and receives and outputs a channel access information response message; and a broadcast control unit that outputs a channel tuning control signal to the broadcast receiving unit according to the channel access information inputted from the channel information acquisition unit.

The broadcast control unit may display the channel access information response message inputted from the channel information acquisition unit, and may output the channel tuning control signal to the broadcast receiving unit when a channel access request command is input.

According to another aspect of the present invention, there is provided a channel information providing module incorporated in a channel information providing server that exchanges data with a broadcast control server and a mobile communication terminal which are connected over a network, including: a program information processing unit that receives program information from the broadcast control server and stores the program information in a database; a channel information retrieving unit that, when a channel access information request message is input from the mobile communication terminal, uses time information concerning the time when an audio signal included in the message is input to read and sort out programs broadcasted at the corresponding time from the database, and compares data concerning the broadcast programs with the audio signal included in the message to retrieve a corresponding broadcast program; and a channel access information providing unit that generates and transmits a response message, which includes channel access information corresponding to the retrieved broadcast program and terminal identification information, to the mobile communication terminal.

The channel access information providing unit may convert the channel access information response message into a short message, and transmit the short message to the mobile communication terminal.

According to another aspect of the present invention, there is provided a method of automatically accessing to DMB that is played in a mobile communication terminal capable of receiving the DMB, the method including the operations of: receiving an automatic channel access selection signal; receiving an audio signal of a channel, which a user desires to access, from a microphone of the mobile communication terminal; generating a channel access information request message that requests channel access information including the audio signal and time information concerning the time when the audio signal is input; transmitting the generated channel access information request message to a channel information providing server; receiving a channel access information response message from the channel information providing server; and accessing to the DMB through the channel access information.

The channel access information response message may be a short message.

The operation of accessing to the DMB may further include: outputting the channel access information response message to a display unit; and when a channel access request command is input, accessing to the DMB by using the channel access information response message.

According to another aspect of the present invention, there is provided a method of providing channel access information that is executed in a channel information providing module incorporated in a channel information providing server that exchanges data with a broadcast control server and a mobile communication terminal over a network, the method including the operations of: receiving a channel access information request message from the mobile communication terminal; comparing broadcast programs store in a database with an audio signal and time information, which are included in the channel access information request message, to retrieve a corresponding broadcast program; generating a response message that includes channel access information, which corresponds to the retrieved broadcast program, and terminal identification information; and transmitting the generated response message to the mobile communication terminal.

The operation of generating a response message may further include converting the channel access information response message into a short message.

The method may further include reading the broadcast programs stored in the database and sorting the broadcast programs on a time basis.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Exemplary embodiments in accordance with the present invention will now be described in detail with reference to the accompanying drawings.

Figure 1:
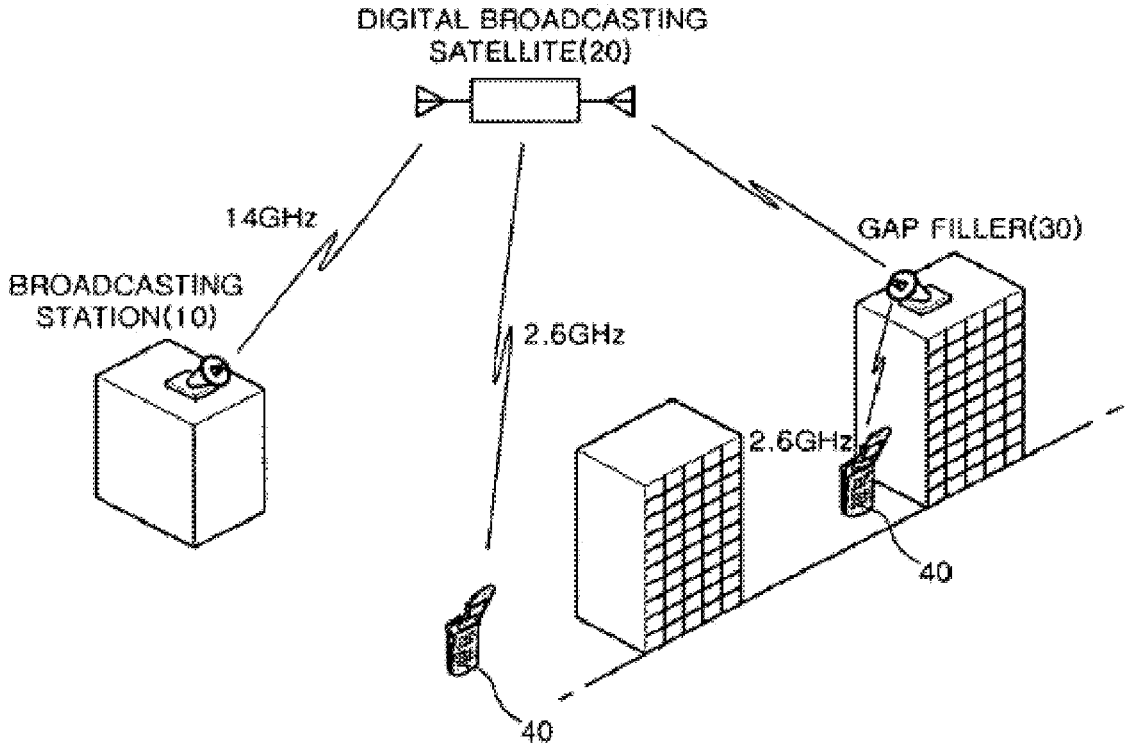
FIG. 1 PRIOR ART
FIG. 1 is a conventional DMB service system.
Figure 2:
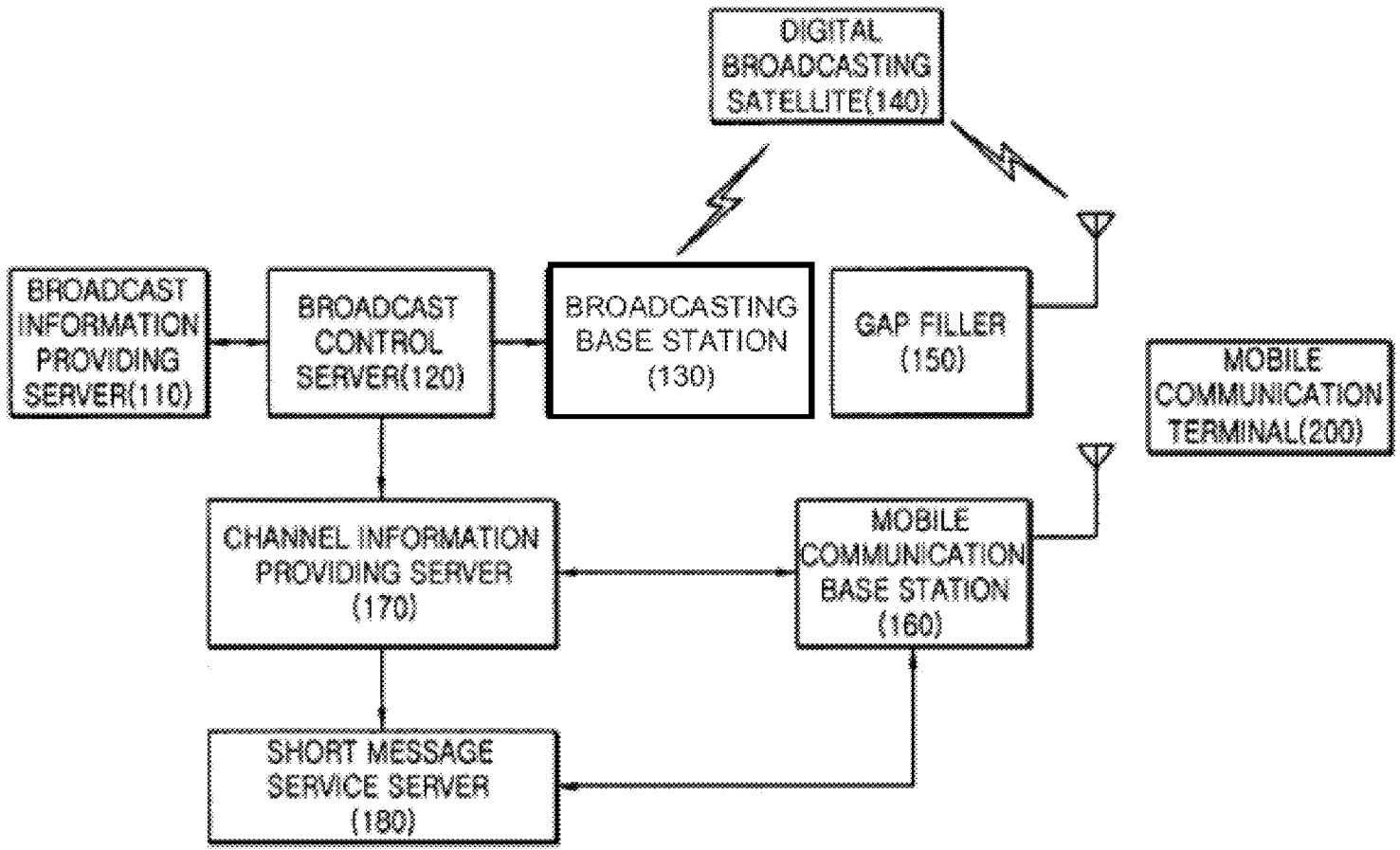
FIG. 2 is a block diagram of a system that provides automatic access to DMB and provides channel access information according to the present invention.

FIG. 2 is a block diagram of a system that provides automatic access to DMB and provides channel access information according to the present invention. The system includes a broadcast information providing server 110, a broadcast control server 120, a broadcasting base station 130, a digital broadcasting satellite 140, a gap filler 150, a mobile communication base station 160, a channel information providing server 170, a short message service server 180, and a mobile communication terminal 200.

The broadcast information providing server 110 provides broadcast content and is normally managed by broadcast providers. The broadcast information providing server 110 may be managed by service providers that provide various kinds of contents, such as drama, baduk, fishing, sports or the like.

The broadcast control server 120 is typically managed by broadcast providers, such as satellite broadcast providers or terrestrial broadcast providers. The broadcast control server 120 stores electronic program guide (EPG) in which various broadcast contents are organized on a channel/time basis, and controls broadcasting of the contents according to the EPG.

The broadcasting base station 130 transmits broadcasting signals to the outside. It may transmit satellite broadcasting signals to the digital broadcasting satellite 140. Alternatively, it may transmit terrestrial waves. Examples of terrestrial transmission standards include ATSC (US standard) DVT-T (European standard), and ISDB-T (Japanese standard).

The digital broadcasting satellite 140 receives a broadcasting signal from the broadcasting base station 130 and retransmits it to the ground. The digital broadcasting satellite 140 may convert a broadcasting signal into a signal with a bandwidth which can be received by a mobile communication terminal and retransmit it. The digital broadcasting satellite 140 may transmit a broadcast signal with a bandwidth which can be received by the gap filler 150 installed at dead spots, such as downtowns.

The mobile communication base station 160 acts to transform data, which is transmitted/received between the mobile communication terminal 200 and a mobile switching center, into a signal with a suitable format, and controls allocation of channels for voice and data. The mobile communication base station 160 can be provided unitarily with or separately from a base station controller that is responsible for collecting information concerning operation of the base station, observing and managing the base station.

The channel information providing server 170 provides DMB information to the mobile communication terminal 200, and is normally operated by a mobile communication provider. It may be operated by service providers that provide broadcast contents. The channel information providing server 170 may be configured to receive a channel access information response message from the broadcast control server 120 over wireless data communication. The channel information providing server 170 may transmit the channel access information response message to the mobile communication terminal through a short message.

The short message service server 180 is connected to a mobile switching center and transmits/receives short messages over a traffic channel or a paging channel. The short message service server 180 may transmit a channel access information response message received from the channel information providing server 170 to a mobile communication terminal.

The mobile communication terminal 200 is preferably equipped with a DMB reception/playback module. When an automatic channel access list is selected among a broadcast menu, it generates and transmits a channel access information request message, which includes an audio signal and time information concerning the time when the audio signal is input, to the channel information providing server 170 over a wireless data communication network. The mobile communication terminal is preferably configured to receive satellite broadcasting signals, which are transmitted from the digital broadcasting satellite 140, or terrestrial broadcasting signals, which are transmitted from the broadcasting base station 130.

Figure 3:
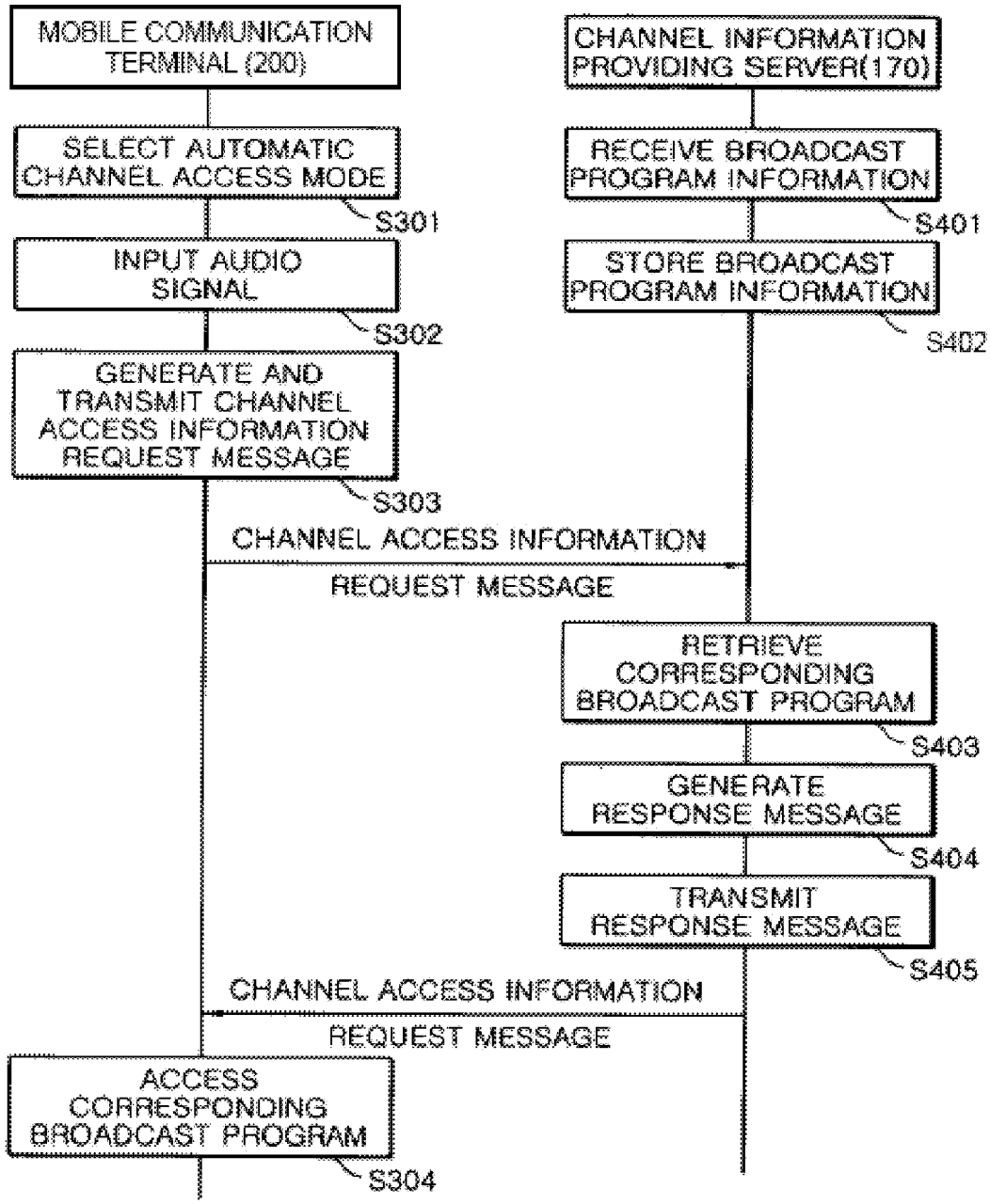
FIG. 3 is a flow chart of providing automatic access to DMB and providing channel access information according to the present invention.

FIG. 3 is a flow chart of providing automatic access to DMB and providing channel access information according to the present invention.

When an automatic channel access list is selected (Operation S301), the mobile communication terminal 200 waits for an audio signal to be input from a microphone of the mobile communication terminal 200. When the audio signal is input (operation S302), the mobile communication terminal 200 converts the inputted analog audio signal into a digital signal. Next, the mobile communication terminal 200 generates a channel access information request message that includes the inputted audio signal and time information concerning the time when the audio signal is input. The channel access information request message may be configured in a long message format or in a short message format. Next, the mobile communication terminal 200 transmits the generated channel access information request message to the channel information providing server 170 (operation S303).

The channel information providing server 170 receives broadcast program information from the broadcast control server 120 (operation S401). The channel information providing server 170 may further store audio information and channel access information, which are organized on a channel/time basis, in a database (operation S402). The audio information stored in the database may be information obtained by converting analog audio information into a digital audio signal, for example, through a vector quantization technique. The audio information may be generated by the channel information providing server 170 or by other content service providers.

Subsequently, when the channel access information request message is input from the mobile communication terminal 200, the channel information providing server 170 uses the audio signal and the time information included in the channel access information request message to retrieve a corresponding broadcast program (operation S403). Next, the channel information providing server 170 generates a response message that includes channel access information corresponding to the retrieved broadcast program and terminal identification information (operation S404). The response message may be configured in a long message format or in a short message format. The channel information providing server 170 transmits the generated response message to the mobile communication terminal 200 (operation S405).

When the response message is input from the channel information providing server 170, the mobile communication terminal 200 uses the channel access information included in the response message to access to corresponding digital broadcasting (operation S304). The mobile communication terminal 200 may output the channel access information response message inputted from the channel information providing server 170 to a display unit, and, when a channel access request is input by a user, accesses to DMB by using the channel access information response message.

Figure 4:
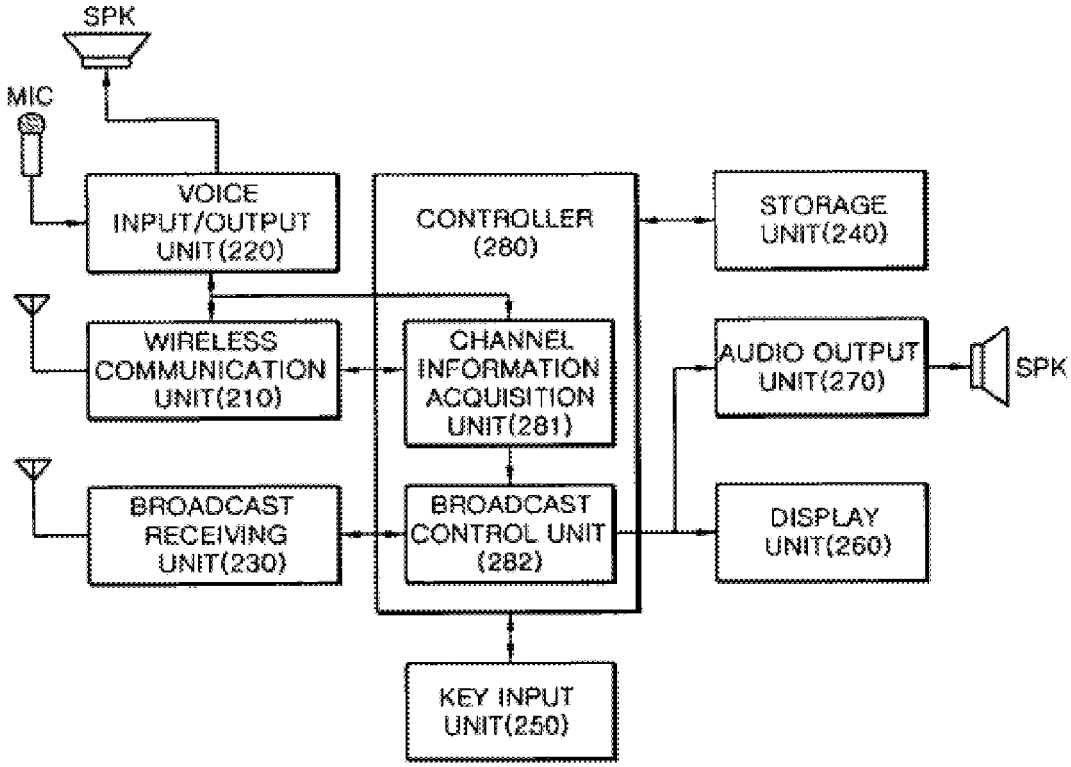
FIG. 4 is a block diagram of a mobile communication terminal according to an embodiment of the present invention.

FIG. 4 is a block diagram of a mobile communication terminal according to an embodiment of the present invention.

The mobile communication terminal includes a wireless communication unit 210, a voice input/output unit 220, a broadcast receiving unit 230, a storage unit 240, a key input unit 250, a display unit 260, a an audio output unit 270, and a controller 280.

The wireless communication unit 210 is configured to include an antenna and a radio frequency (RF) circuit to communicate with a base station. The wireless communication unit 210 is construed to comprehend existing mobile communication systems, such as CDMA, cellular, GSM, or W-CDMA, as well as future mobile communication systems. In one embodiment, a baseband circuit of the wireless communication unit 210 and most circuits of the controller 280 are integrated into a commercially available IC chip. The voice input/output unit 220 converts digital voice data received from the wireless communication unit 210 into an analog voice signal and outputs it to a speaker. The voice input/output unit 220 converts an analog voice signal inputted from a microphone into a digital voice signal. The voice input/output unit 220 is a well-known component including well-known circuits such as an audio amplifier and a filter.

The broadcast receiving unit 230 receives and demodulates terrestrial or satellite broadcasting signal, and divides the broadcasting signal into a video signal and an audio signal. In one embodiment, the broadcast receiving unit 230 includes a tuner, a TP processor that divides a broadcasting signal into an audio/video signal and data, an audio/video signal processor that restores the divided audio/video signal, and a data processor that restores the divided data to original data. The storage unit 240 stores execution programs and related data. The storage unit 240 may be configured as a single chip including a SRAM (static random access memory) with a capacity of several megabits, and a flash memory with a capacity of tens of megabits.

The key input unit 250 allows a user to input the user's instructions. Examples of the key input unit 250 include a keypad, which is composed of numeral keys, function keys, and the like, a sidekey, a touch panel, a handwriting input unit, a voice recognition device, and the like. The display unit 260, which is typically LCD device, displays operating conditions of the terminal, menu selection screen, and the like.

The audio output unit 270 converts a digital broadcasting audio signal inputted from the broadcast receiving unit 230 to an analog audio signal. The audio output unit 270 may be configured as an audio chip that supports surround audio output.

The controller 280 controls the entire system, and includes hardware for internal communication, a digital signal processor, and a universal microprocessor. The controller 280 includes a channel information acquisition unit 281 and a broadcast control unit 282.

The channel information acquisition unit 281 processes an audio signal inputted from the microphone in an automatic channel access mode, generates and transmits a channel access information request message, which includes the audio signal and time information the time when the audio signal is input, to the channel information providing server 170, and receives and outputs the channel access information. In one embodiment, the channel information acquisition unit 281 compresses, for example, by a vector quantization method, and converts an analog audio signal into a digital audio signal. The channel access information request message may be transferred in a long message format or in a short message format.

The broadcast control unit 282 outputs a channel tuning control signal to the broadcast receiving unit 230 according to the channel access information inputted from the channel information acquisition unit 281. The broadcast control unit 282 displays a channel access information response message inputted from the channel information acquisition unit 281 and, when the channel access request command is input, outputs the channel tuning control signal to the broadcast receiving unit.

Figure 5:
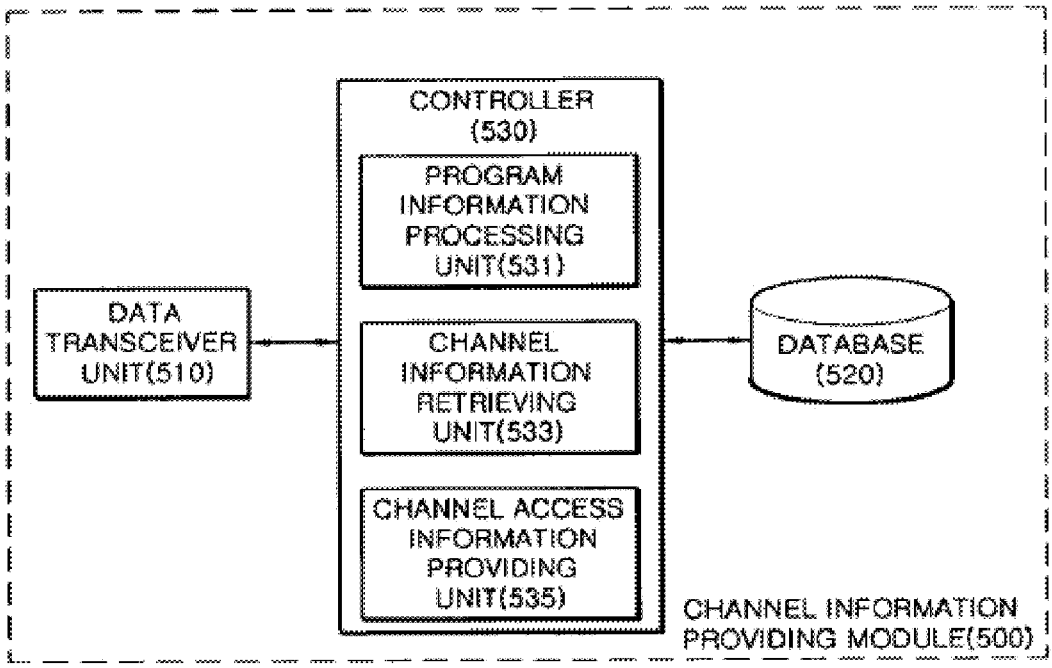
FIG. 5 is a block diagram of a channel information providing module according to another embodiment of the present invention.

FIG. 5 is a block diagram of a channel information providing module 500 according to an embodiment of the present invention. The channel information providing module 500 includes a data transceiver unit 510, a database 520, and a controller 530.

The data transceiver unit 510 is responsible for transmitting/receiving data to/from external units, such as a broadcast control server, a short message service server, or the like. The database 520 stores broadcast program information inputted from the broadcast control server. The broadcast program information may include channel access information and audio information organized on a channel/time basis. The audio information stored in the database is information obtained by converting an analog audio signal into a digital audio signal by a vector quantization method. The audio information may be generated by the channel information providing server 170 or by external content providers.

The controller 530 controls the entire system, and includes a program information processing unit 531, a channel information retrieving unit 533, and a channel access information providing unit 535.

The program information processing unit 531 receives program information from the broadcast control server and stores it in the database 520. The program information processing unit 531 may sort out broadcast programs on a channel/time basis beforehand and stores it in the database 520.

When receiving a channel access information request message from a mobile communication terminal, the channel information retrieving unit 533 reads and sorts out programs broadcasted at a corresponding time from the database by using time information concerning the time when the audio signal included in the message is input, and compares data of the sorted broadcast programs with the audio signal included in the message to retrieve the corresponding program.

The channel access information providing unit 535 generates and transmits a response message, which includes channel access information corresponding to the retrieved broadcast program and terminal identification information, to the mobile communication terminal. The channel access information providing unit 535 may generate the response message in a long message format or in a short message format.

Figure 6:
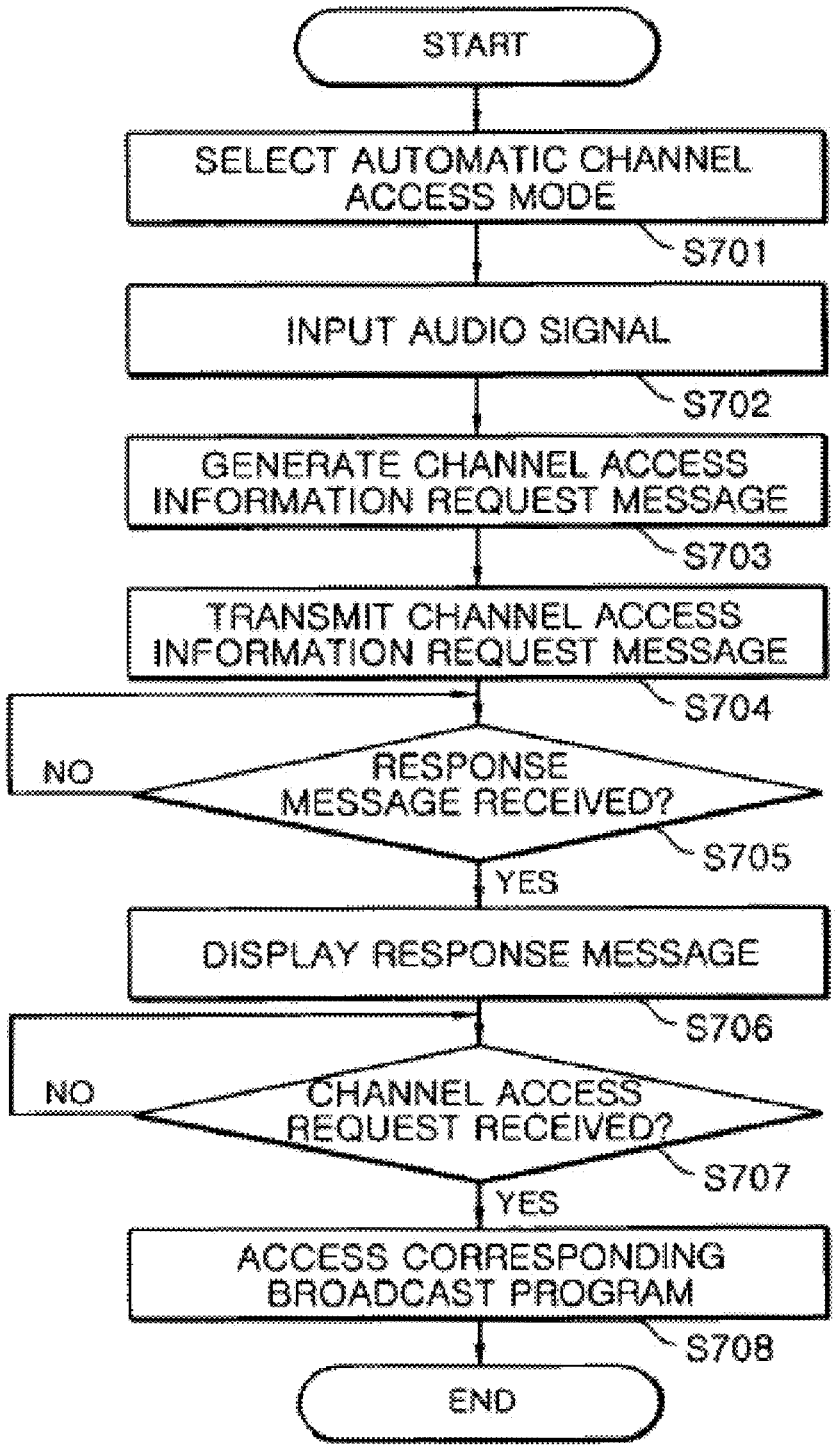
FIG. 6 is a flow chart of a process for automatically accessing to DMB that is played in a mobile communication terminal according to another embodiment of the present invention.

FIG. 6 is a flow chart of a process for automatically accessing to DMB which is played in a mobile communication terminal according to an embodiment of the present invention.

When a user presses a menu button of a mobile communication terminal, the mobile communication terminal displays a menu. When the user selects, for example, a digital broadcast viewing mode, the mobile communication terminal displays a sub-menu that includes an automatic channel access mode.

When the automatic channel access mode is selected from the user (operation S701), the mobile communication terminal waits for an audio signal to be input from a microphone. When the audio signal is input from the microphone (operation S702), the mobile communication terminal converts the inputted analog audio signal into a digital signal. The mobile communication terminal generates a channel access information request message that includes the audio signal and time information concerning the time when the audio signal is input (operation S703). The channel access information request message may be formed in a long message format or in a short message format. The mobile communication terminal transmits the channel access information request message to the channel information providing server 170 (operation S704).

The mobile communication terminal next determines whether a response message is received (operation S705). When a response message is input from the channel information providing server 170, the mobile communication terminal outputs the response message to a display unit (operation S706). When a channel access request is received from the user (operation S707), the mobile communication terminal uses the channel access information response message to access the DMB (operation S708). Accordingly, the user needs neither to retrieve the EPG to search for a desired program, nor to select channel information displayed in the display unit to confirm that it is his/her desired program.

Figure 7:
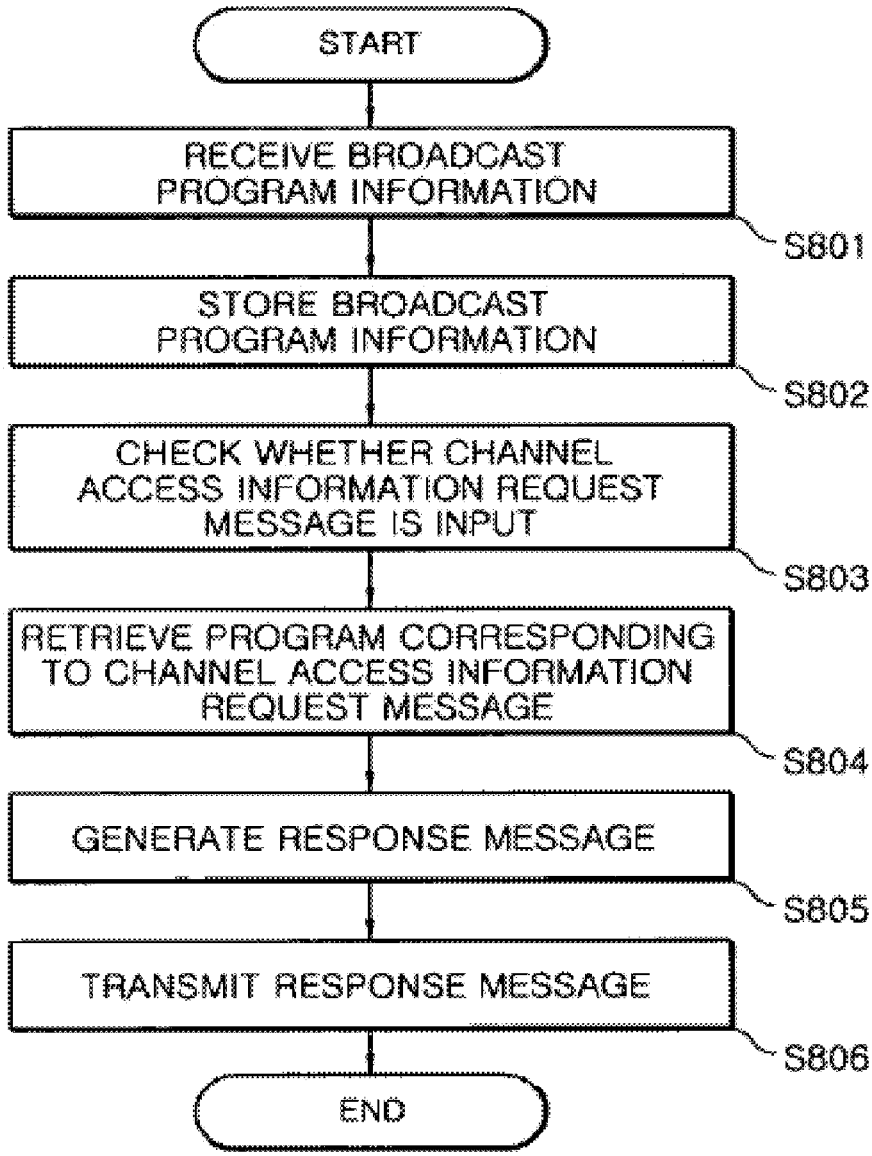
FIG. 7 is a flow chart of a process for providing channel access information that is executed in a channel information providing server according to another embodiment of the present invention.

FIG. 7 is a flow chart of a process for providing channel access information that is executed in a channel information providing server according to another embodiment of the present invention.

The channel information providing server receives broadcast program information from a broadcast control server (operation S801). The channel information providing server stores the broadcast program information in the database (operation S802). The channel information providing server stores audio information organized on a channel/time basis in the database. The audio information stored in the database may be information obtained by converting analog audio information into a digital audio signal, for example, through a vector quantization technique. The audio information may be generated by the channel information providing server or by other content service providers.

The channel information providing server may further include reading broadcast programs previously stored in the database and sorting the programs on a time basis. The channel information providing server compares data of the sorted broadcast programs with the audio signal included in the message to retrieve the corresponding broadcast program.

The channel information providing server checks whether the channel access information request message is input from the mobile communication terminal (operation S803). The channel information providing server is configured to check whether the channel access information request message is input. When the channel access information request message is input, the channel information providing server compares the broadcast programs stored in the database with the audio signal and the time information included in the channel access information request message to retrieve the corresponding broadcast program (operation S804).

The channel information providing server generates a response message including the channel access information and the terminal identification information that correspond to the retrieved broadcast program (operation S805). The response message may be configured in a long message format or in a short message format. The channel information providing server transmits the generated response message to the mobile communication terminal 200 (operation S806).

As apparent from the above description, according to the present invention, the mobile communication terminal can automatically access to DMB when an audio signal of the DMB is input to the mobile communication terminal. In addition, it is not necessary for a user, which uses the mobile communication terminal, to retrieve the EPG to search for his/her desired broadcast program, or to select channel information displayed in the display unit and check whether or not the received broadcast program is his/her desired program.

While the present invention has been described with reference to exemplary embodiments thereof, it will be understood by those skilled in the art that various changes in form and details may be made therein without departing from the scope of the present invention as defined by the following claims.

What is claimed is:

1. A mobile communication terminal that can automatically access to broadcast or VOD (Video on demand), comprising:

a broadcast receiving unit to receive, demodulate, and output a broadcast or VOD signal;

a channel information acquisition unit to process an inputted sound information, to generate and transmit to a channel information providing server a channel access information request message that includes the sound information, and to receive and output a channel access information response message; and a broadcast control unit to output a channel tuning control signal to the broadcast receiving unit according to the channel access information inputted from the channel information acquisition unit.

2. A channel information providing module incorporated in a channel information providing server that exchanges data with a broadcast control server and a mobile communication terminal which are connected over a network, comprising:

a program information processing unit to receive program information from the broadcast control server and to store the program information in a database;

a channel information retrieving unit that, when a channel access information request message is inputted from the mobile communication terminal, uses a sound information included in the message to read and sort out programs broadcasted at the corresponding time from the database, and compares data concerning the broadcast programs with the sound information included in the message to retrieve a corresponding broadcast program; and a channel access information providing unit to generate and transmit a response message, which includes channel access information corresponding to the retrieved broadcast program and terminal identification information, to the mobile communication terminal.

3. A method for automatically accessing to broadcast or VOD (Video on demand), that is played in a mobile communication terminal capable of receiving the broadcast or VOD, the method comprising the operations of:

receiving a sound information concerning a channel, which a user desires to access;

generating a channel access information request message that requests channel access information including the sound information;

transmitting the generated channel access information request message to a channel information providing server;

receiving a channel access information response message from the channel information providing server; and accessing to the broadcast or the VOD through the channel access information.

4. A method for providing channel access information that is executed in a channel information providing module incorporated in a channel information providing server that exchanges data with a broadcast control server and a mobile communication terminal over a network, the method comprising the operations of:

receiving a channel access information request message from the mobile communication terminal, the channel access information request message comprising a sound information;

comparing broadcast programs stored in a database with the sound information to retrieve a corresponding broadcast program;

generating a response message that includes channel access information, which corresponds to the retrieved broadcast program, and terminal identification information; and transmitting the generated response message to the mobile communication terminal.

* * * * *